US008613239B2

(12) United States Patent
Lee

(10) Patent No.: US 8,613,239 B2
(45) Date of Patent: Dec. 24, 2013

(54) CONVERTIBLE DRIVING TOOL

(76) Inventor: Jack Lee, Taichung (TW)

( * ) Notice: Subject to any disclaimer, the term of this patent is extended or adjusted under 35 U.S.C. 154(b) by 170 days.

(21) Appl. No.: 13/402,954

(22) Filed: Feb. 23, 2012

(65) Prior Publication Data

US 2013/0220081 A1 Aug. 29, 2013

(51) Int. Cl.
*B25B 23/16* (2006.01)
*B25B 13/46* (2006.01)

(52) U.S. Cl.
USPC ..... 81/60; 81/177.85

(58) Field of Classification Search
USPC ..... 81/60, 177.2, 177.7, 177.8, 177.85, 81/177.9, 58–58.4; 403/300, 302, 306, 403/310, 311, 313
See application file for complete search history.

(56) References Cited

U.S. PATENT DOCUMENTS 5,331,869 A * 7/1994 Webb ..... 81/177.1
5,477,758 A * 12/1995 Cunningham ..... 81/177.85
5,685,208 A * 11/1997 Tidwell ..... 81/177.85
6,000,299 A 12/1999 Cole
6,032,555 A 3/2000 Whitley
6,161,982 A 12/2000 Cole
6,752,048 B1 6/2004 Chiang
6,993,998 B1 2/2006 Kao et al.
7,137,323 B1 * 11/2006 Hsieh ..... 81/467
8,096,213 B2 * 1/2012 Miers ..... 81/177.85
2007/0062346 A1 * 3/2007 Hsieh ..... 81/177.7
2010/0175514 A1 * 7/2010 Hsieh ..... 81/177.2
2010/0175515 A1 * 7/2010 Chen ..... 81/177.85

* cited by examiner

*Primary Examiner* — David B Thomas

(57) ABSTRACT

A convertible driving tool includes a tool handle having a carrier, a tool head having a shank for engaging into a compartment of the carrier, and a latch device includes a shaft engageable through the shank and the carrier, and the shaft includes a catch member for being engaged between the shank and the carrier for selectively latching the shank to the carrier, the catch member of the latch device is disengageable from the shank for allowing the tool head to be easily and quickly and readily attached or coupled to the tool handle and to be disengaged from the tool handle, and for allowing the driving tool head to be easily and quickly and readily changed or replaced with the new ones.

9 Claims, 6 Drawing Sheets

CONVERTIBLE DRIVING TOOL

BACKGROUND OF THE INVENTION

1. Field of the Invention

The present invention relates to a convertible driving tool, and more particularly to a convertible driving tool including a convertible or changeable structure for allowing a driving tool head or driving cartridge to be easily and quickly and readily attached or mounted or secured or coupled to the tool handle or disengaged from the tool handle, and for allowing the driving tool head or driving cartridge to be easily and quickly and readily changed or replaced with the new ones.

2. Description of the Prior Art

Typical driving tools comprise a driving tool head or driving cartridge pivotally or rotatably attached or mounted or secured or coupled to the tool handle for allowing the driving tool head or driving cartridge to be rotated or driven or actuated by the tool handle.

For example, U.S. Pat. No. 6,000,299 to Cole, U.S. Pat. No. 6,032,555 to Whitley, U.S. Pat. No. 6,161,982 to Cole, U.S. Pat. No. 6,752,048 to Chiang, and U.S. Pat. No. 6,993,998 to Kao et al. disclose several of the typical driving tools each also comprising a driving tool head or driving cartridge pivotally or rotatably attached or mounted or secured or coupled to a tool handle for allowing the driving tool head or driving cartridge to be rotated or driven or actuated by the tool handle.

However, the driving tool head or driving cartridge is normally solidly attached or mounted or secured or coupled to the tool handle with one or more fasteners and/or one or more retaining rings such that the driving tool head or driving cartridge may not be disengaged from the tool handle, and such that the driving tool head or driving cartridge may not be changed or replaced with the new ones, when required. For example, when the old or previous driving tool head or driving cartridge has been damaged, or when the old or previous driving tool head or driving cartridge is not the required size or dimension or standard and is required to be changed or replaced with the new ones that include the required size or dimension or standard.

The present invention has arisen to mitigate and/or obviate the afore-described disadvantages of the conventional driving tool devices.

SUMMARY OF THE INVENTION

The primary objective of the present invention is to provide a convertible driving tool including a convertible or changeable structure for allowing a driving tool head or driving cartridge to be easily and quickly and readily attached or mounted or secured or coupled to the tool handle or disengaged from the tool handle, and for allowing the driving tool head or driving cartridge to be easily and quickly and readily changed or replaced with the new ones.

In accordance with one aspect of the invention, there is provided a convertible driving tool comprising a tool handle including a carrier, the carrier including a compartment formed therein, and including an orifice formed therein and communicative with the compartment of the carrier, a tool head including a shank for selectively engaging into the compartment of the carrier, the shank including an aperture formed therein for selectively aligning with the orifice of the carrier, and including an opening formed therein and communicative with the aperture of the shank for outwardly opening the aperture of the shank, and including two opposite anchors formed between the aperture and the opening of the shank, and a latch device including a shaft engageable in the aperture of the shank and the orifice of the carrier, the shaft including an outer diameter smaller a distance between the anchors of the shank for allowing the shaft to be engaged through the opening and the anchors and into the aperture of the shank, and including a catch member extended radially and outwardly therefrom and having an outer diameter greater than the distance between the anchors of the shank for preventing the catch member from being moved through the anchors of the shank, and the shaft being engageable through the opening and the anchors and into the aperture of the shank when the catch member of the latch device is disengaged from the aperture of the shank, and the shaft being prevented from moving relative to the shank and the carrier, and the shank of the tool head being latched to the carrier and being prevented from disengaging from the carrier when the catch member is engaged in both the aperture of the shank and the orifice of the carrier.

The carrier includes an upper wall and a bottom wall for forming or defining the compartment of the carrier, the orifice of the carrier is formed through the upper wall and the bottom wall of the carrier.

The shaft includes a peripheral flange extended radially and outwardly therefrom and slidably engaged in the orifice of the upper wall of the carrier. The catch member is slidably engaged in the orifice of the lower wall of the carrier.

The latch device includes a spring biasing member engaged with the shaft for biasing and forcing the catch member of the shaft to engage into the aperture of the shank and to latch and lock the shank of the tool head to the carrier. The latch device includes a cavity formed in the shaft for receiving and engaging with the spring biasing member.

The carrier includes an inclined engaging surface formed in each of the anchors, and the shaft includes an inclined guiding surface formed between the shaft and the catch member for engaging with the inclined engaging surface of the shank and for guiding the catch member of the shaft to engage into the aperture of the shank.

The tool head includes a ratchet member pivotally attached to the tool head with a pivot shaft. The ratchet member includes an engaging hole formed therein for receiving or engaging with the fasteners or other tool elements to be rotated or driven or actuated by the tool head and the tool handle.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
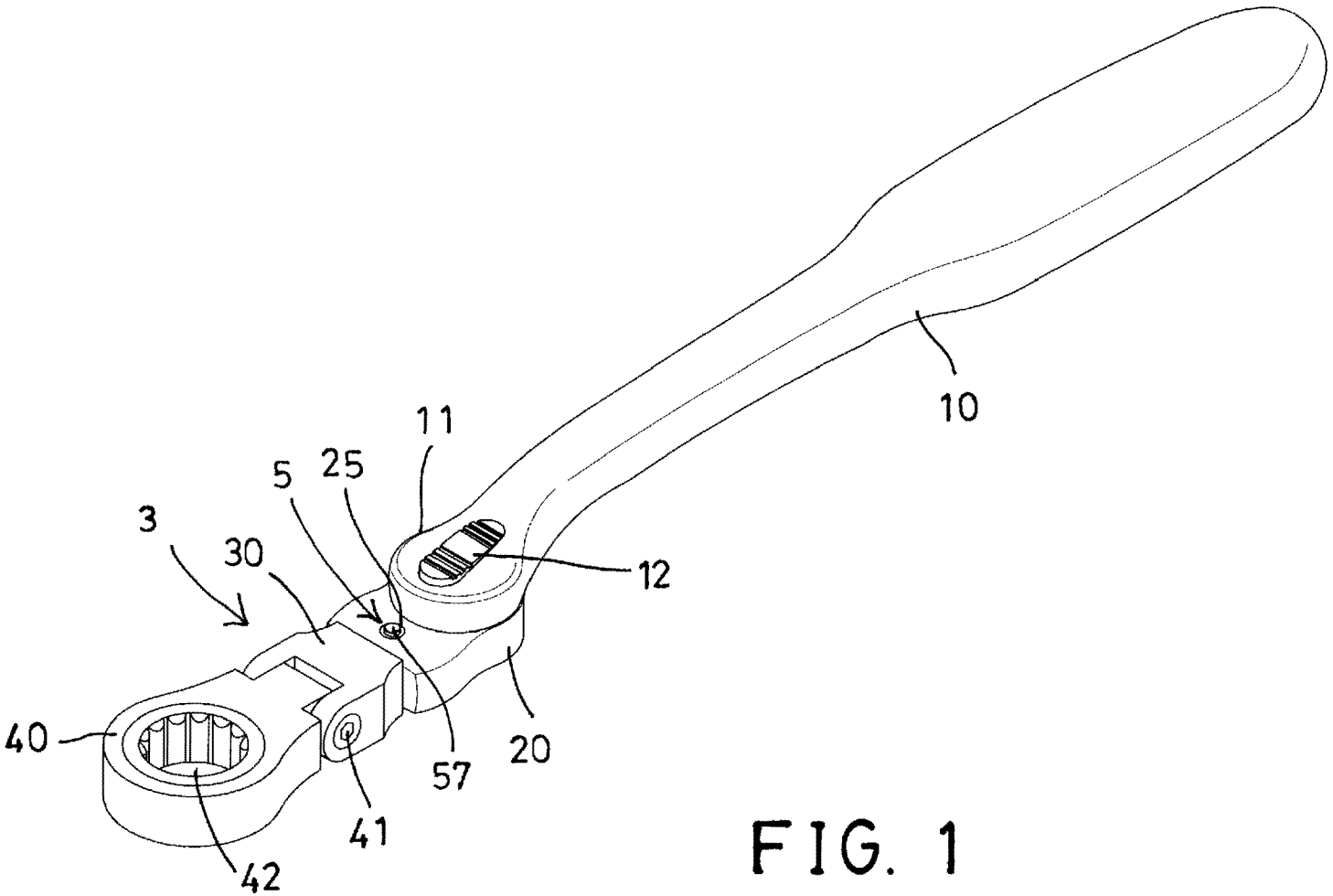
FIG. 1 is a perspective view of a convertible driving tool in accordance with the present invention.
Figure 2:
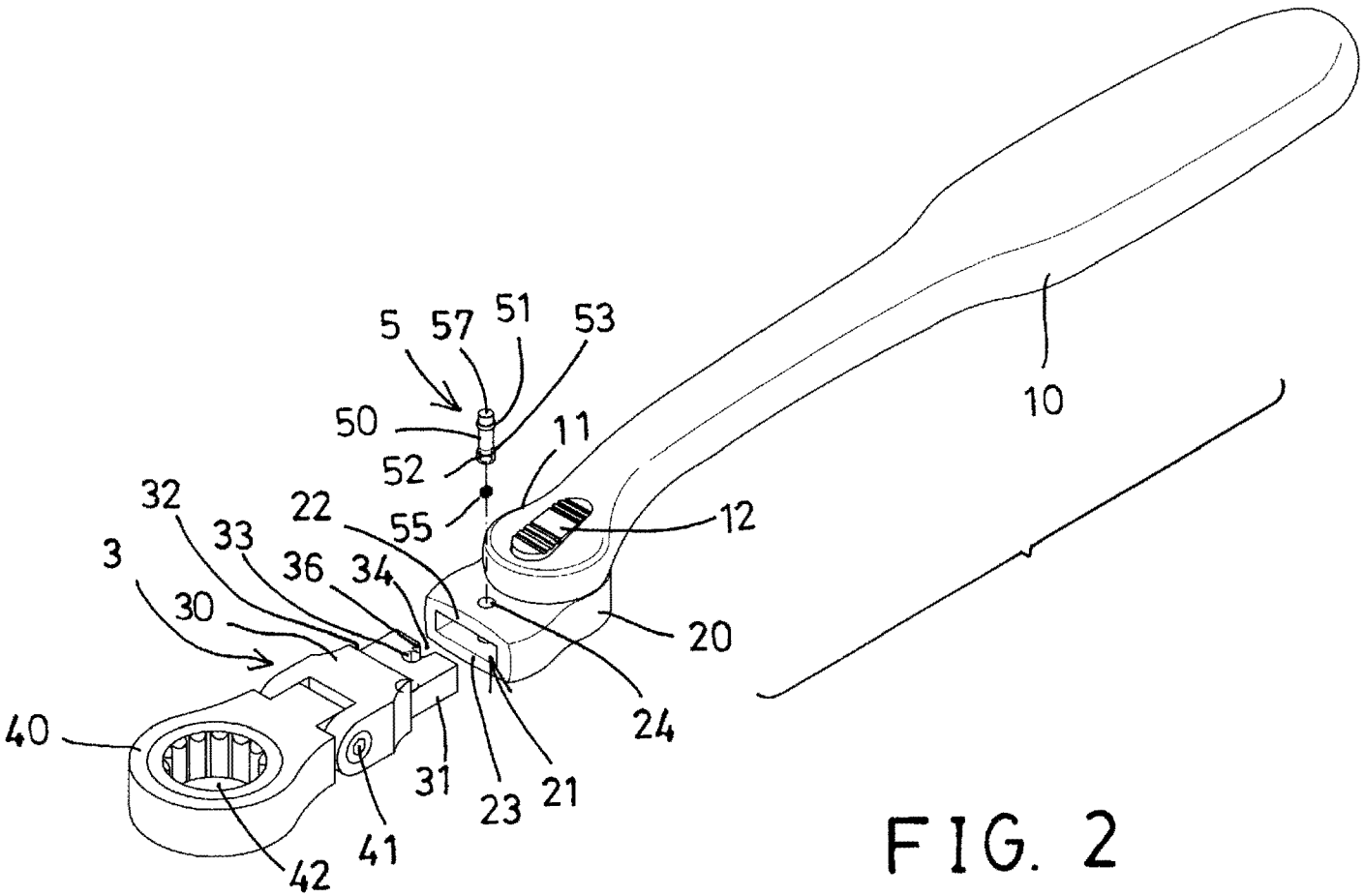
FIG. 2 is a partial exploded view of the convertible driving tool.
Figure 3:
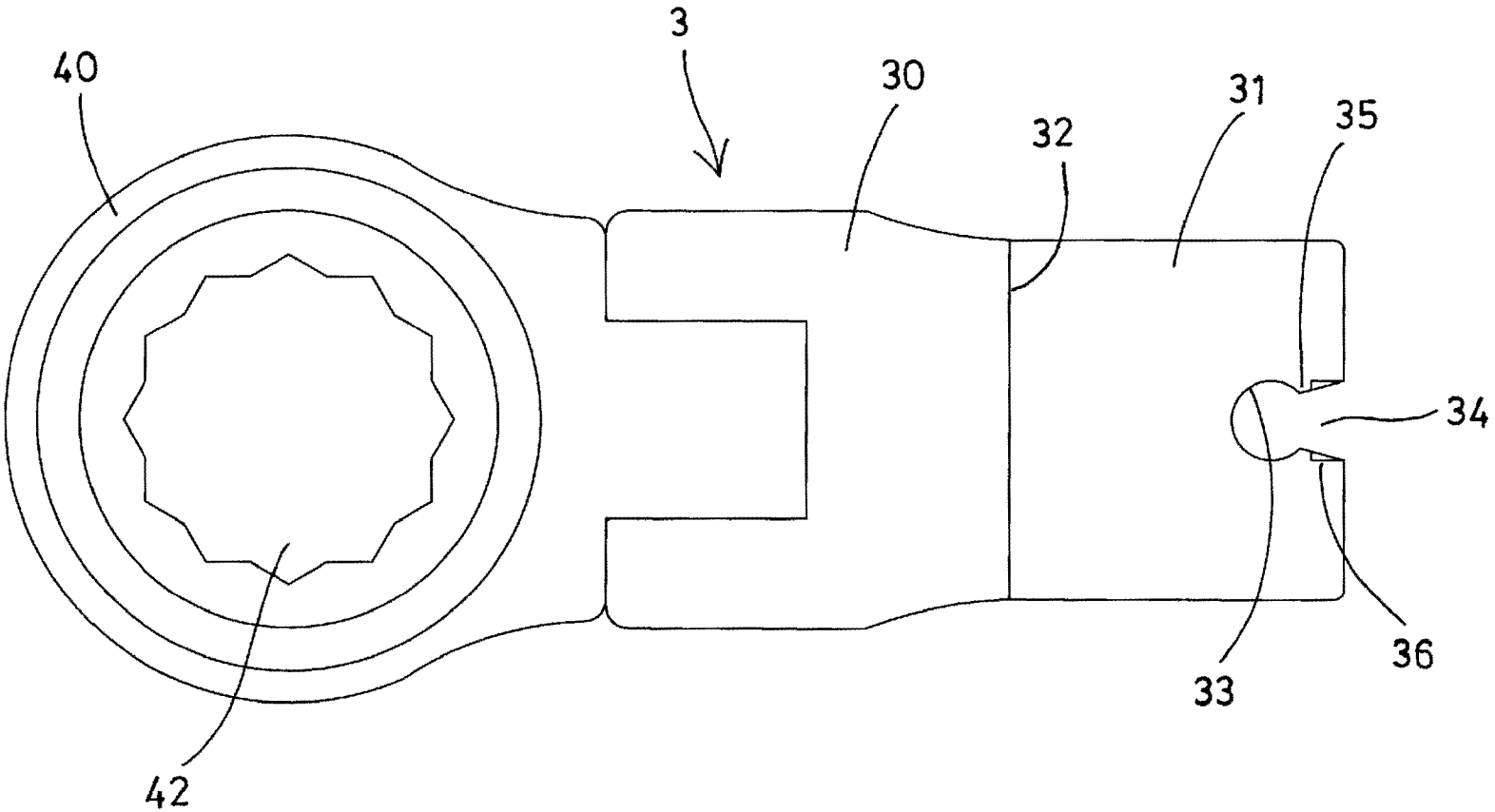
FIG. 3 is a partial top plan schematic view of the convertible driving tool.

Referring to the drawings, and initially to FIGS. 1-5, a convertible driving tool in accordance with the present invention comprises a driving tool handle 10, a seat or casing or cartridge or carrier 20 pivotally or rotatably attached or mounted or secured or coupled to one end 11 of the tool handle 10, and a control knob or device 12 attached or mounted or secured or coupled to the tool handle 10 and engaged with the carrier 20 (not shown) for determining or controlling the driving direction of the carrier 20 with or by the tool handle 10 and for allowing the carrier 20 to be rotated or driven or actuated in either the clockwise or the counter clockwise direction by the tool handle 10. The above-described structure or configuration for the control knob or device 12 is typical and is not related to the present invention and will not be described in further details.

The carrier 20 includes a socket chamber or compartment 21 formed therein and formed or defined by an upper wall 22 and a bottom wall 23, and faced or directed or opened forwardly for receiving or engaging with a driving cartridge or driving tool head 3, and includes an orifice 24 formed therein, such as formed through the upper wall 22 and the bottom wall 23 of the carrier 20 and intersected or communicative with the compartment 21 of the carrier 20. The compartment 21 of the carrier 20 includes a non-circular cross section, such as a quadrilateral, square, rectangular cross section, or the like having the upper wall 22 and the bottom wall 23 spaced from each other and parallel to each other.

The driving tool head 3 includes a stem 30 having a narrowed or reduced shank 31 extended outwardly therefrom, and the shank 31 includes an outer diameter or size or dimension or standard smaller than that of the stem 30 for forming or defining a peripheral shoulder or abutment 32 between the stem 30 and the shank 31, and the shank 31 includes an outer shape or contour or cross section similar or identical to that of the compartment 21 of the carrier 20 for allowing the shank 31 to be inserted or engaged into the compartment 21 of the carrier 20 (FIG. 6), and thus for allowing the shank 31 and the stem 30 of the tool head 3 to be attached or mounted or secured or coupled to the carrier 20 of the tool handle 10. The abutment 32 of the tool head 3 is engageable with the carrier 20 (FIG. 4) for limiting the relative movement between the carrier 20 and the tool head 3.

The driving tool head 3 further includes an aperture 33 formed therein, such as formed in the shank 31 and having a size or dimension or standard or inner diameter similar or identical or equal to that of the orifice 24 of the carrier 20 (FIG. 4) for selectively aligning with the orifice 24 of the carrier 20 and for selectively receiving or engaging with a latch device 5. The shank 31 further includes a notch or opening 34 formed therein and communicative with the aperture 33 thereof for allowing the aperture 33 of the shank 31 to be opened outwardly, and thus for allowing the latch device 5 to be selectively engaged through the opening 34 and then engaged into the aperture 33 of the shank 31. The opening 34 of the shank 31 is tilted or narrowed toward the aperture 33 of the shank 31 for forming or defining a tilted or narrowed neck portion or two opposite projections or anchors 35 between the aperture 33 and the opening 34 of the shank 31.

It is preferable that the shank 31 further includes a tilted or inclined engaging surface 36 formed in either or both the upper and the lower portion of each of the anchors 35 for slidably or smoothly engaging with the latch device 5, which will be discussed hereinafter. The driving tool head 3 may further include a ratchet member 40 pivotally or rotatably attached or mounted or secured or coupled to the stem 30 of the tool head 3 with a pivot shaft 41, and the ratchet member 40 may include an engaging hole 42 formed therein for receiving or engaging with the fasteners or other tool elements (not shown) that are to be rotated or driven or actuated by the tool head 3 and/or the tool handle 10 of the convertible driving tool.

The latch device 5 includes a shaft 50 having an outer diameter smaller than that of the aperture 33 of the shank 31 and the orifice 24 of the carrier 20 for slidably receiving or engaging within the aperture 33 of the shank 31 and the orifice 24 of the carrier 20, and includes an enlarged annular or peripheral flange 51 and an enlarged engaging or catch member 52 extended radially and outwardly therefrom and having an outer diameter slightly smaller than or identical or equal to that of the orifice 24 of the carrier 20 and the aperture 33 of the shank 31 for slidably and snugly fitted or received or engaged in the orifice 24 of the carrier 20, and for slidably engaging with the upper wall 22 and the bottom wall 23 of the carrier 20 respectively. The tool handle 10 includes a rivet or stop or anchoring or securing or retaining element 25 extended radially and inwardly into the orifice 24 of the upper wall 22 of the carrier 20 for selectively or suitably engaging with the enlarged annular or peripheral flange 51 of the shaft 50 and for anchoring or limiting or retaining the shaft 50 in the orifice 24 of the carrier 20, and for preventing the shaft 50 from being disengaged from the carrier 20.

The outer diameter of the shaft 50 is slightly smaller than or equal to that of the space or distance between the anchors 35 of the shank 31 for allowing the shaft 50 to be selectively engaged through the opening 34 and passing through the anchors 35 and then engaged into the aperture 33 of the shank 31. The outer diameter of the catch member 52 is slightly smaller than or identical or equal to that of the orifice 24 of the carrier 20 and the aperture 33 of the shank 31, but greater than that of the space or distance between the anchors 35 of the shank 31 for preventing the catch member 52 from being moved through the anchors 35 of the shank 31 and for anchoring or securing or retaining or positioning the shaft 50 of the latch device 5 to the carrier 20 and the shank 31 of the tool head 3, and thus for latching or locking the shank 31 of the tool head 3 to the carrier 20.

It is preferable that the latch device 5 further includes a tilted or inclined guiding surface 53 formed between the shaft 50 and the catch member 52 for selectively or suitably engaging with the inclined engaging surface 36 of the shank 31 of the tool head 3 and for suitably guiding the catch member 52 of the shaft 50 to engage into the aperture 33 of the shank 31 and thus for latching or locking the shank 31 of the tool head 3 to the carrier 20. The shaft 50 of the latch device 5 further includes a cavity 54 formed therein for receiving or engaging with a spring biasing member 55 which may bias and force the shaft 50 out of the orifice 24 of the carrier 20 and which may bias and force the catch member 52 of the shaft 50 to engage into the aperture 33 of the shank 31 and thus to latch and lock the shank 31 of the tool head 3 to the carrier 20.

Figure 4:
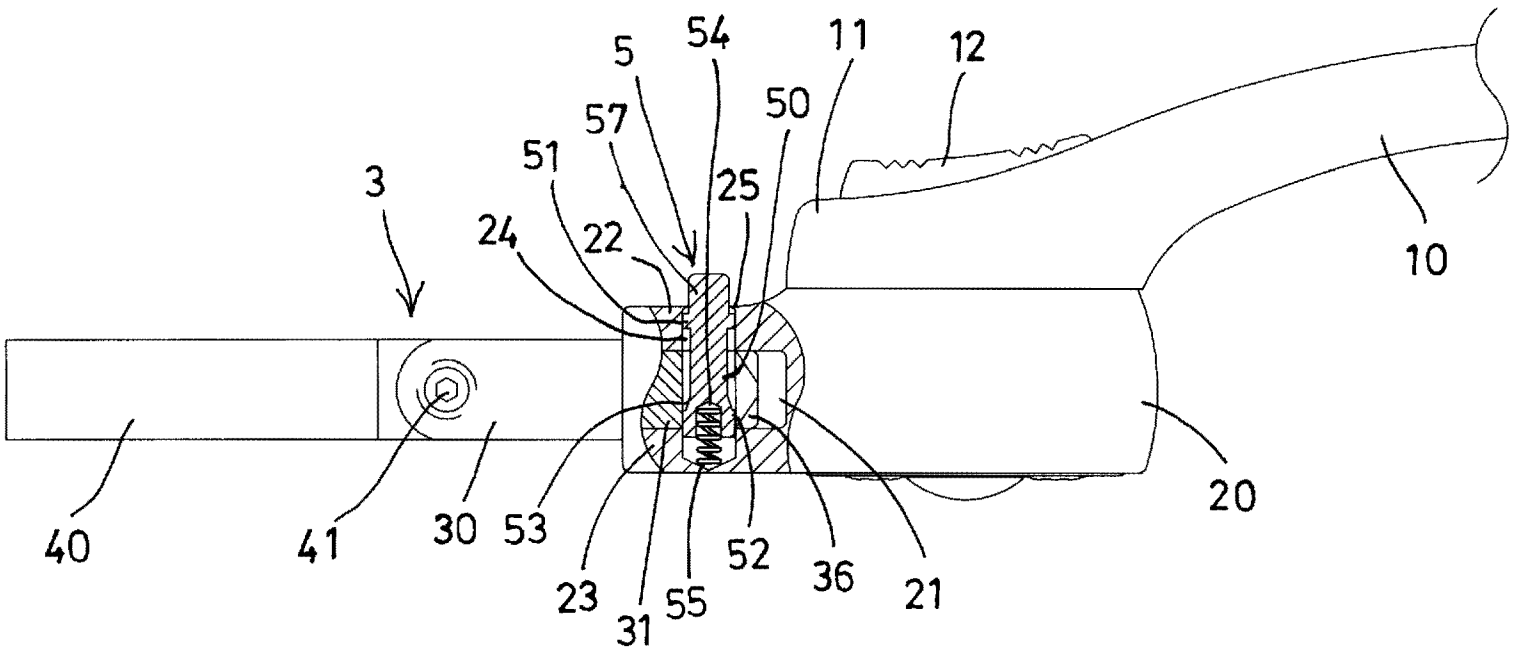
FIG. 4 is a partial side plan schematic view of the convertible driving tool as shown in FIG. 1, in which a portion of the convertible driving tool has been cut off for showing the inner structure of the convertible driving tool.
Figure 5:
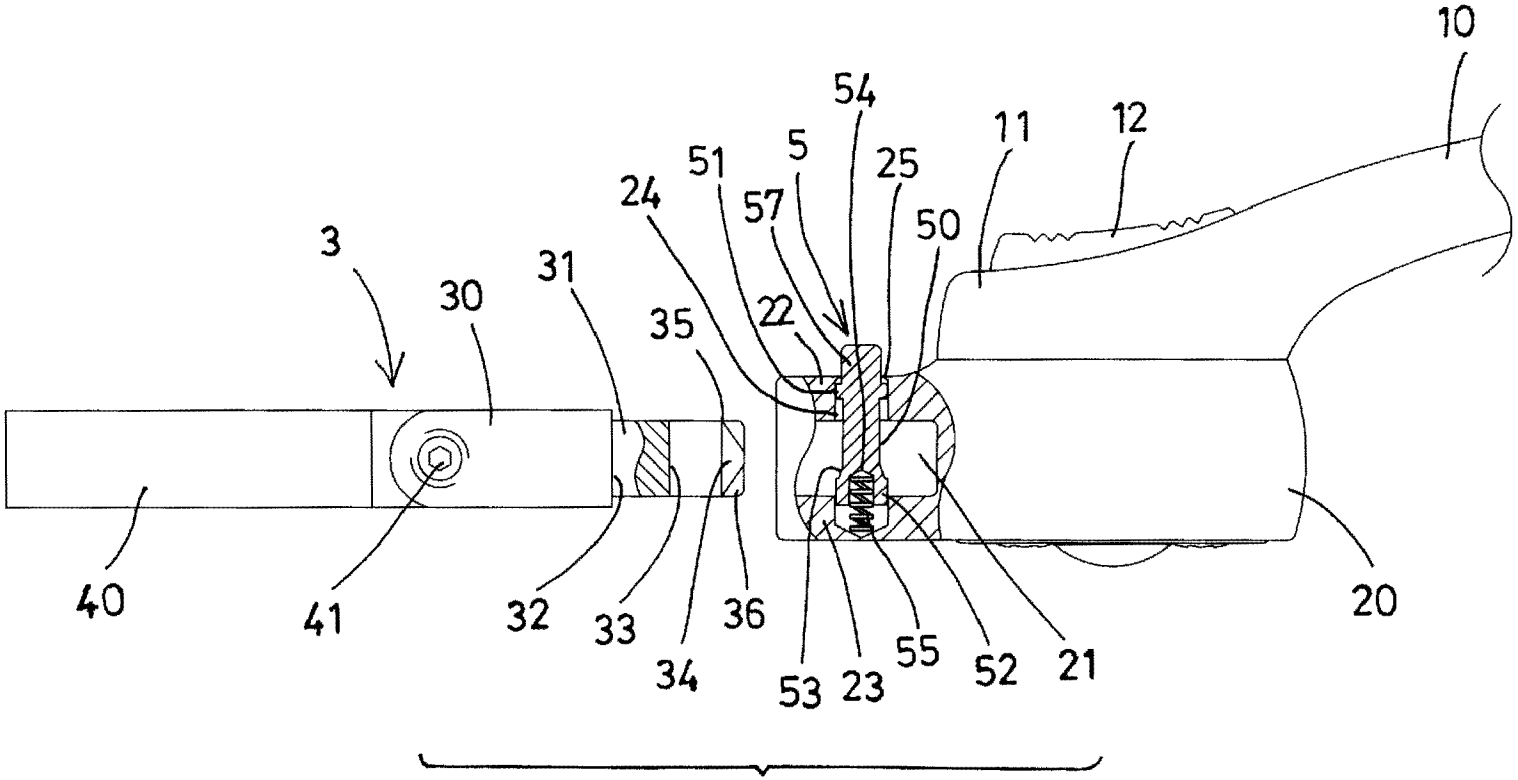
FIG. 5 is another partial side plan schematic view of the convertible driving tool as shown in FIG. 2, in which a portion of the convertible driving tool has also been cut off for showing the inner structure of the convertible driving tool.
Figure 6:
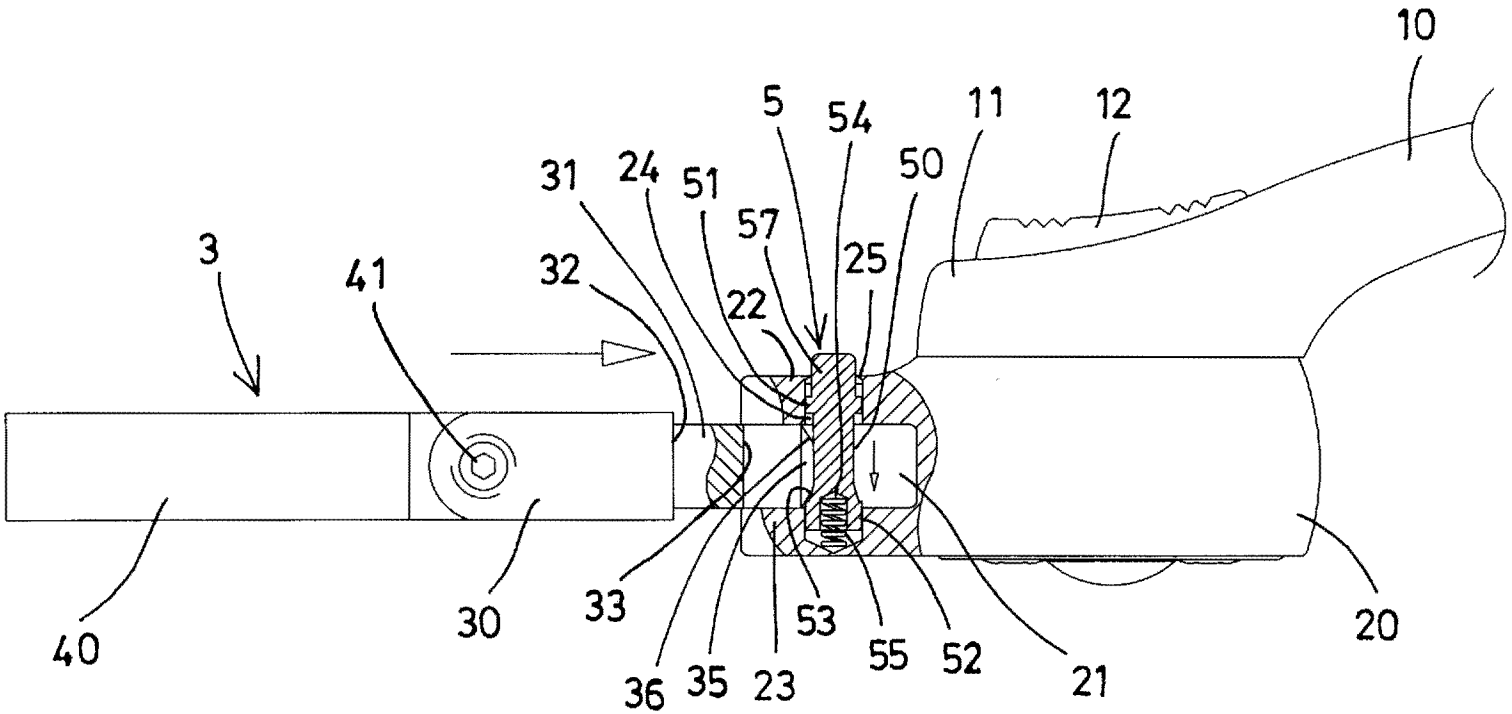
FIG. 6 is a further partial side plan schematic view similar to FIGS. 4 and 5, illustrating the operation of the convertible driving tool.

In operation, as shown in FIGS. 4-6, the knob or hand grip or outer end portion 57 of the shaft 50 may be biased and forced to move out of the orifice 24 and the upper wall 22 of the carrier 20 with or by the spring biasing member 55, and the catch member 52 of the shaft 50 may also be biased and forced to engage into the aperture 33 of the shank 31 in order to latch and lock the shank 31 of the tool head 3 to the carrier 20. When the outer end portion 57 of the shaft 50 is depressed into the carrier 20 by the user and to force and compress the spring biasing member 55, the catch member 52 of the shaft 50 may be moved and disengaged from the aperture 33 of the shank 31 for allowing the shank 31 of the tool head 3 to be selectively engaged into or disengaged from the carrier 20 and thus for allowing the tool head 3 to be selectively changed or replaced with the new ones.

When the shank 31 of the selected tool head 3 is engaged into the compartment 21 of the carrier 20, the inclined engaging surface 36 of the shank 31 of the tool head 3 may be arranged to be selectively engaged with the guiding surface 53 of the shaft 50 of the latch device 5 and to move or force the shaft 50 to depress and to compress the spring biasing member 55, and then to allow the shaft 50 to be selectively engaged through the opening 34 and passing through the anchors 35 and then engaged into the aperture 33 of the shank 31, and the spring biasing member 55 may then bias and force the catch member 52 of the shaft 50 to engage into the aperture 33 of the shank 31 and thus to latch and lock the shank 31 of the tool head 3 to the carrier 20 when the shaft 50 is moved through the anchors 35.

Accordingly, the convertible driving tool in accordance with the present invention includes a convertible or changeable structure for allowing a driving tool head or driving cartridge to be easily and quickly and readily attached or mounted or secured or coupled to the tool handle or disengaged from the tool handle, and for allowing the driving tool head or driving cartridge to be easily and quickly and readily changed or replaced with the new ones.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A convertible driving tool comprising:

a tool handle including a carrier, said carrier including a compartment formed therein, and including an orifice formed therein and communicative with said compartment of said carrier, a tool head including a shank for selectively engaging into said compartment of said carrier, said shank including an aperture formed therein for selectively aligning with said orifice of said carrier, and including an opening formed therein and communicative with said aperture of said shank for outwardly opening said aperture of said shank, and including two opposite anchors formed between said aperture and said opening of said shank, and a latch device including a shaft engageable in said aperture of said shank and said orifice of said carrier, said shaft including an outer diameter smaller a distance between said anchors of said shank for allowing said shaft to be engaged through said opening and said anchors and into said aperture of said shank, and including a catch member extended radially and outwardly therefrom and having an outer diameter greater than the distance between said anchors of said shank for preventing said catch member from being moved through said anchors of said shank, and said shaft being engageable through said opening and said anchors and into said aperture of said shank when said catch member of said latch device is disengaged from said aperture of said shank, and said shaft being prevented from moving relative to said shank and said carrier, and said shank of said tool head being latched to said carrier and being prevented from disengaging from said carrier when said catch member is engaged in both said aperture of said shank and said orifice of said carrier.

2. The convertible driving tool as claimed in claim 1, wherein said carrier includes an upper wall and a bottom wall for defining said compartment of said carrier, said orifice of said carrier is formed through said upper wall and said bottom wall of said carrier.

3. The convertible driving tool as claimed in claim 2, wherein said shaft includes a peripheral flange extended radially and outwardly therefrom and slidably engaged in said orifice of said upper wall of said carrier.

4. The convertible driving tool as claimed in claim 2, wherein said catch member is slidably engaged in said orifice of said lower wall of said carrier.

5. The convertible driving tool as claimed in claim 1, wherein said latch device includes a spring biasing member engaged with said shaft for biasing and forcing said catch member of said shaft to engage into said aperture of said shank and to latch and lock said shank of said tool head to said carrier.

6. The convertible driving tool as claimed in claim 5, wherein said latch device includes a cavity formed in said shaft for receiving and engaging with said spring biasing member.

7. The convertible driving tool as claimed in claim 1, wherein said carrier includes an inclined engaging surface formed in each of said anchors, and said shaft includes an inclined guiding surface formed between said shaft and said catch member for engaging with said engaging surface of said shank and for guiding said catch member of said shaft to engage into said aperture of said shank.

8. The convertible driving tool as claimed in claim 1, wherein said tool head includes a ratchet member pivotally attached to said tool head with a pivot shaft.

9. The convertible driving tool as claimed in claim 8, wherein said ratchet member includes an engaging hole formed therein.

* * * * *